US011317701B2

(12) United States Patent
Beckhart

(10) Patent No.: US 11,317,701 B2
(45) Date of Patent: May 3, 2022

(54) LANYARD ATTACHMENT DEVICE AND LANYARD SYSTEM USING THE SAME

(71) Applicant: Gordon Haggott Beckhart, Colorado Springs, CO (US)

(72) Inventor: Gordon Haggott Beckhart, Colorado Springs, CO (US)

( * ) Notice: Subject to any disclaimer, the term of this patent is extended or adjusted under 35 U.S.C. 154(b) by 41 days.

(21) Appl. No.: 16/892,506

(22) Filed: Jun. 4, 2020

(65) Prior Publication Data

US 2021/0045516 A1 Feb. 18, 2021

Related U.S. Application Data

(63) Continuation-in-part of application No. 29/702,249, filed on Aug. 17, 2019, now Pat. No. Des. 936,463.

(51) Int. Cl.

| | |
|---|---|
| ***A45F 5/02*** | (2006.01) |
| ***A45F 5/00*** | (2006.01) |
| ***A45C 13/30*** | (2006.01) |
| ***A45C 11/00*** | (2006.01) |

(52) U.S. Cl.

CPC ..... *A45F 5/00* (2013.01); *A45C 11/00* (2013.01); *A45C 13/30* (2013.01); *A45C 2011/002* (2013.01); *A45F 2005/006* (2013.01); *A45F 2005/026* (2013.01); *A45F 2200/0516* (2013.01)

(58) Field of Classification Search

CPC ..... A45F 2005/026; A45F 2005/006; A45F 2200/0516; A45F 5/00; Y10T 24/4599; Y10T 24/3653; A44B 11/2584

USPC ..... 224/197, 217–218, 605, 607, 614–615, 224/618, 257, 269, 271, 272

See application file for complete search history.

(56) References Cited

U.S. PATENT DOCUMENTS

| | | | |
|---|---|---|---|
| 2,905,991 | A | 9/1959 | Reiter |
| 3,878,589 | A | 4/1975 | Schaefer |
| 4,419,794 | A | 12/1983 | Horton, Jr. et al. |
| 4,605,335 | A | 8/1986 | Otrusina |

(Continued)

FOREIGN PATENT DOCUMENTS

| | | |
|---|---|---|
| CN | 2094915 U | 2/1992 |

OTHER PUBLICATIONS

"11off Bear and rabbit popsocket case with lanyard for iPhoneXS max XS XR X 8 8P 7 7P", YouTube Website, Web page <https://www.youtube.com/watch?v=6zK-Z6KZ13M>, pp. 3, dated Oct. 15, 2018, retrieved from www.youtube.com on Dec. 5, 2020.

(Continued)

*Primary Examiner* — Adam J Waggenspack

(74) *Attorney, Agent, or Firm* — The Law Office of Patrick F. O'Reilly III, LLC

(57) ABSTRACT

A lanyard attachment device and lanyard system using the same is disclosed herein. The lanyard attachment device includes a first leg portion, the first leg portion configured to be attached to a first end of a lanyard; a second leg portion, the second leg portion configured to be attached to a second end of the lanyard; and a base portion connected to the first leg portion and the second leg portion. The first leg portion, the second leg portion, and the base portion collectively defining a closed-ended slot for receiving a stem portion of a device holder. The lanyard system includes a lanyard and a lanyard attachment device configured to be attached to the lanyard.

20 Claims, 10 Drawing Sheets

(56) References Cited

U.S. PATENT DOCUMENTS

| | | | | |
|---|---|---|---|---|
| 4,676,420 | A * | 6/1987 | Sharp | A45F 5/00 224/197 |
| 4,982,885 | A | 1/1991 | Severson et al. | |
| 5,054,170 | A | 10/1991 | Otrusina | |
| 5,347,693 | A | 9/1994 | Otrusina | |
| 5,620,120 | A * | 4/1997 | Tien | A45F 5/02 224/199 |
| 5,913,463 | A * | 6/1999 | Carr | A45F 5/00 224/148.4 |
| 6,932,309 | B1 | 8/2005 | Corey et al. | |
| 7,458,489 | B1 * | 12/2008 | Mudd | A45F 5/02 224/197 |
| 8,055,005 | B2 | 11/2011 | Liu et al. | |
| 8,141,210 | B2 | 3/2012 | Colorado | |
| 8,356,736 | B2 * | 1/2013 | Musgrave | A45F 5/02 224/197 |
| 8,833,620 | B2 | 9/2014 | Interdonato | |
| 9,033,199 | B2 | 5/2015 | Weber | |
| D781,710 | S | 3/2017 | Kudrowitz et al. | |
| D832,684 | S | 11/2018 | Moore | |
| D837,040 | S | 1/2019 | Connor et al. | |
| D847,618 | S | 5/2019 | Acevedo | |
| D849,516 | S | 5/2019 | Johnson | |
| D865,494 | S | 11/2019 | Adelman | |
| D867,768 | S | 11/2019 | Wright | |
| D891,911 | S | 8/2020 | Lin | |
| D893,986 | S | 8/2020 | Adelman | |
| D898,548 | S | 10/2020 | Elliott | |
| D899,896 | S | 10/2020 | Palmer | |
| D901,281 | S | 11/2020 | Fox | |
| D903,472 | S | 12/2020 | Kovacs et al. | |
| D904,468 | S | 12/2020 | Ju | |
| D911,151 | S | 2/2021 | Smith | |
| 2005/0115999 | A1 | 6/2005 | Johnson | |
| 2008/0299407 | A1 | 12/2008 | Amboy | |
| 2013/0255118 | A1 | 10/2013 | Warren | |
| 2014/0090209 | A1 * | 4/2014 | Smith | F16M 11/041 24/3.12 |

OTHER PUBLICATIONS

"Bone Lanyard Phone Tie, Universal Cell Phone Lanyard Case, Silicone Neck Strap Smartphone Case for iPhone XS Max XS XR X SE2 8 7 6S 6 Plus Samsung Galaxy S10 S9 S8 Note 9, Google Pixel 3 XL LG, Phone Tie Series (Black)", Amazon Website, Web page <https://www.amazon.com/Universal-Lanyard-Silicone-Smartphone-Samsung/dp/B07KVYS8P6>, pp. 12, dated Jan. 20, 2019, retrieved from www.amazon.com website on Dec. 5, 2020.

"PopSockets—PopClip-Mount-Combo", iPromo Website, Web page <https://www.ipromo.com/promo-item/IP-POPC42/PopSockets—PopClip-Mount-Combo.html?cid=20072>, pp. 9, dated at least as early as May 9, 2019, retrieved from www.ipromo.com on Dec. 5, 2020.

PCT Form 210, International Search Report for PCT/US2020/042247, dated Sep. 17, 2020.

PCT Form 237, Written Opinion of the International Searching Authority for PCT/US2020/042247, dated Sep. 17, 2020.

* cited by examiner

Section A-A

Section B-B

LANYARD ATTACHMENT DEVICE AND LANYARD SYSTEM USING THE SAME

CROSS-REFERENCE TO RELATED APPLICATIONS

This patent application is a continuation-in-part of U.S. Design patent application No. 29/702,249, entitled "Lanyard Attachment Device", filed on Aug. 17, 2019, the disclosure of which is hereby incorporated by reference as if set forth in its entirety herein.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a lanyard attachment device and lanyard system using the same. More particularly, the invention relates to a lanyard attachment device that may be used with a handheld electronic device, such as a smartphone, so that the handheld electronic device is able to be supported from a lanyard.

2. Background

There is clearly a need to carry our mobile phones with us at all times. In fact, many folks feel naked without their cell phone. Women have additional issues keeping their phones handy because they frequently have clothing without pockets, or pockets that are more decorative than functional. Women's pockets are sometimes left out of clothing, and when added to clothing are often smaller than men's pockets. Smaller pockets, or no pockets, combined with phones getting larger means that women have a tougher time keeping their phones nearby. There are also times when we have no pockets to carry a phone such as walking on the beach in a bathing suit.

Cell phones are frequently put down, forgotten about, and therefore lost or lost for a time. Losing a phone is a stressful event, since so much of our life, contacts, emails, and photos are stored in the phone. Many phones have been placed on a car roof or trunk, while loading groceries or other items in the car, leading to an unfortunate demise of the phone.

There are conventional lanyards and holders designed to hold phones or other devices. Some of these conventional holders are a stretchy rubber net that captures the phone. A shortcoming of this type of holder is that it covers some of the screen face of the phone. It also does not allow for changing of the lanyard to a more fashionable item. There also are magnetic holders to hold phones in stationary locations or on a car dash or air vent. These magnetic devices, which are typically a flat magnet mount and a flat steel plate on the phone or phone case, would not work to securely hold a phone in place at the end of a lanyard while walking or during any other activity. In addition, there are cases made with attachment points. These are a secure method of holding a phone, but require a special case that is less common.

Therefore, what is needed is a lanyard attachment device that allows someone to easily attach and carry their phone or other device on a lanyard. In addition, a lanyard attachment device is needed that allows an easy on attachment, a secure attachment, and easy off detachment for quick accessibility to the phone or other device.

BRIEF SUMMARY OF EMBODIMENTS OF THE INVENTION

Accordingly, the present invention is directed to a lanyard attachment device and lanyard system using the same that substantially obviates one or more problems resulting from the limitations and deficiencies of the related art.

In accordance with one or more embodiments of the present invention, there is provided a lanyard attachment device that includes a first leg portion, the first leg portion configured to be attached to a first end of a lanyard; a second leg portion, the second leg portion configured to be attached to a second end of the lanyard; and a base portion connected to the first leg portion and the second leg portion. The first leg portion, the second leg portion, and the base portion collectively define a closed-ended slot for receiving a stem portion of a device holder.

In a further embodiment of the present invention, the first leg portion of the lanyard attachment device comprises a first fastener aperture configured to receive a first fastener for attaching the first leg portion of the lanyard attachment device to the first end of the lanyard.

In yet a further embodiment, the second leg portion of the lanyard attachment device comprises a second fastener aperture configured to receive a second fastener for attaching the second leg portion of the lanyard attachment device to the second end of the lanyard.

In still a further embodiment, at least one side of the first fastener aperture comprises a counterbore for accommodating a recessed mounting of the first fastener.

In yet a further embodiment, the counterbore comprises a serrated bottom surface for preventing a loosening of the first fastener.

In still a further embodiment, the lanyard attachment device further comprises a recess configured to accommodate a recessed mounting of a disk portion of the device holder.

In yet a further embodiment, at least one side portion of the recess is unbounded by a wall so as to facilitate a grasping and pulling of the disk portion of the device holder by a user.

In still a further embodiment, the recess is circular in shape.

In yet a further embodiment, the first leg portion, the second leg portion, and the base portion collectively form a Y-shaped body configuration.

In still a further embodiment, the lanyard attachment device further comprises a protruding finger tab portion at a bottom end of the base portion so as to facilitate a grasping of the lanyard attachment device by a user when a handheld device is being removed from the lanyard attachment device.

In accordance with one or more other embodiments of the present invention, there is provided a lanyard system that includes a lanyard having a first end and a second end; and a lanyard attachment device. The lanyard attachment device includes a first leg portion, the first leg portion configured to be attached to the first end of the lanyard; a second leg portion, the second leg portion configured to be attached to the second end of the lanyard; and a base portion connected to the first leg portion and the second leg portion. The first leg portion, the second leg portion, and the base portion collectively defining a closed-ended slot for receiving a stem portion of a device holder.

In a further embodiment of the present invention, the first leg portion of the lanyard attachment device comprises a first fastener aperture configured to receive a first fastener for attaching the first leg portion of the lanyard attachment device to the first end of the lanyard.

In yet a further embodiment, the second leg portion of the lanyard attachment device comprises a second fastener aperture configured to receive a second fastener for attaching the second leg portion of the lanyard attachment device to the second end of the lanyard.

In still a further embodiment, at least one side of the first fastener aperture comprises a counterbore for accommodating a recessed mounting of the first fastener, the counterbore comprising a serrated bottom surface for preventing a loosening of the first fastener.

In yet a further embodiment, the lanyard attachment device further comprises a recess configured to accommodate a recessed mounting of a disk portion of the device holder.

In still a further embodiment, the recess is circular in shape, and at least one side portion of the recess is unbounded by a wall so as to facilitate a grasping and pulling of the disk portion of the device holder by a user.

In yet a further embodiment, the first leg portion, the second leg portion, and the base portion of the lanyard attachment device collectively form a Y-shaped body configuration.

In still a further embodiment, the lanyard attachment device further comprises a protruding finger tab portion at a bottom end of the base portion so as to facilitate a grasping of the lanyard attachment device by a user when a handheld device is being removed from the lanyard attachment device.

In yet a further embodiment, the lanyard attachment device is configured to couple a smartphone to the lanyard.

In still a further embodiment, the device holder comprises a hand grip holder for the smartphone, and the closed-ended slot of the base portion of the lanyard attachment device is configured to receive the stem portion of the hand grip holder.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
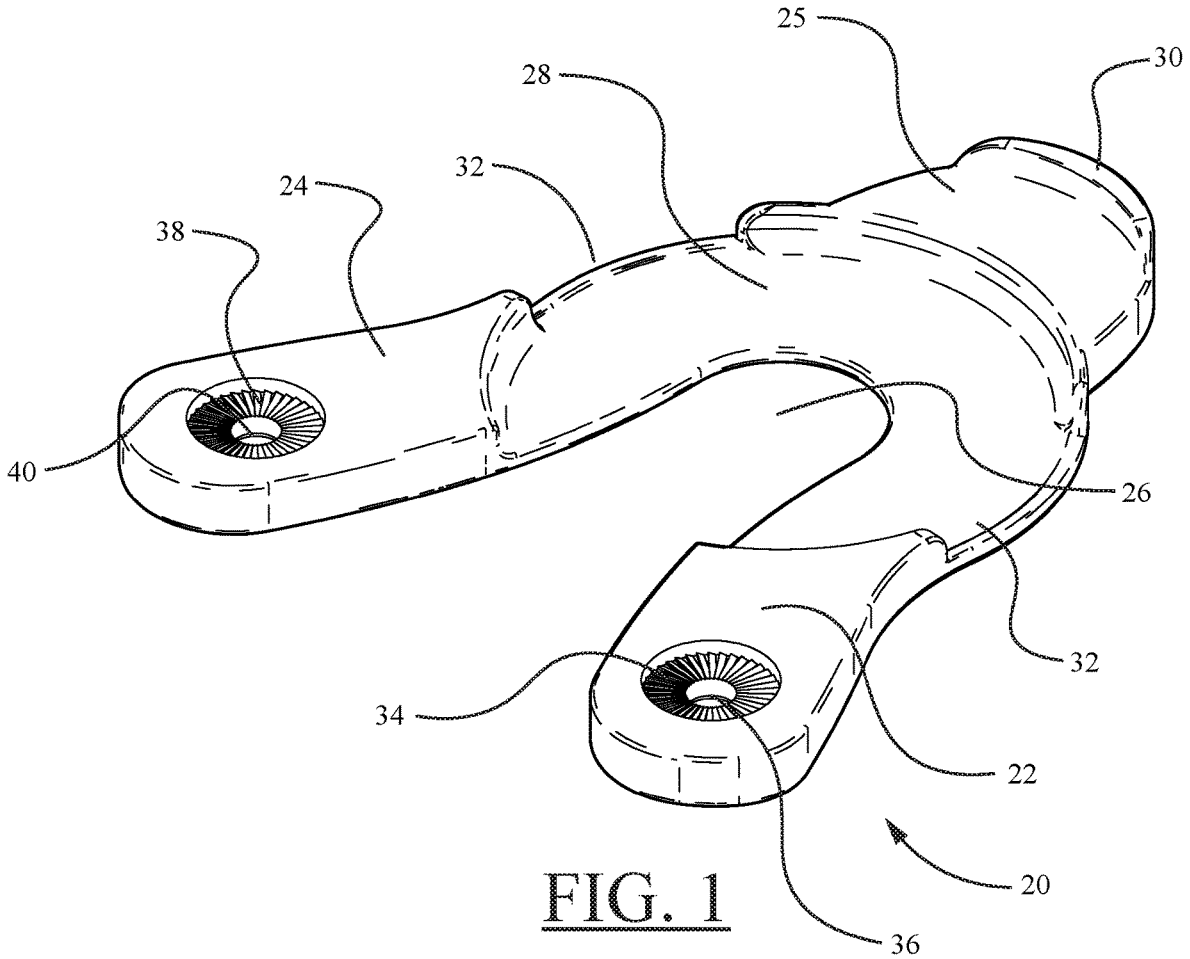
FIG. 1 is a front-side perspective view of a lanyard attachment device, according to an illustrative embodiment of the invention.
Figure 2:
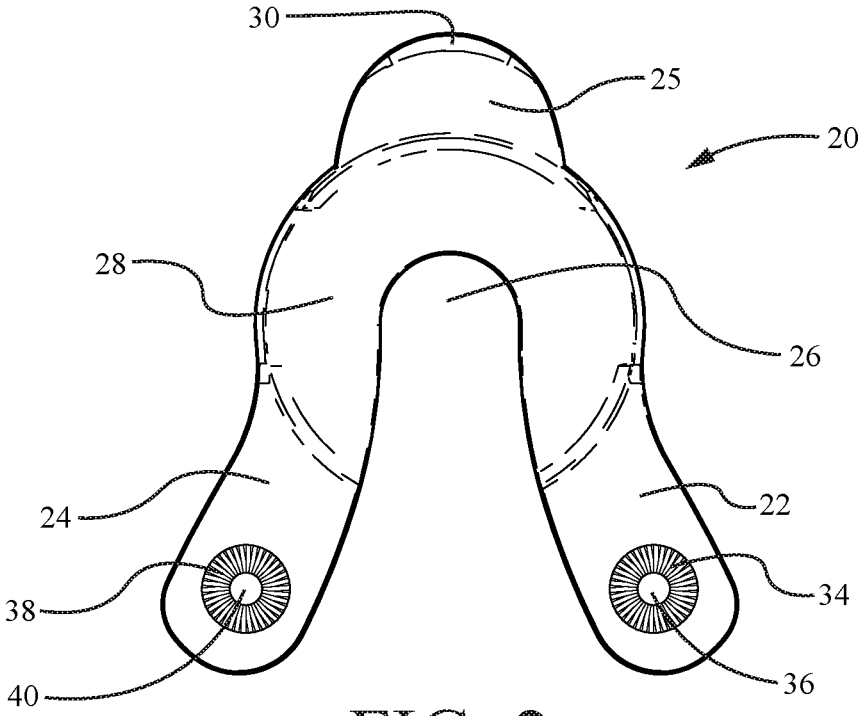
FIG. 2 is a front elevational view of the lanyard attachment device of FIG. 1.
Figure 3:
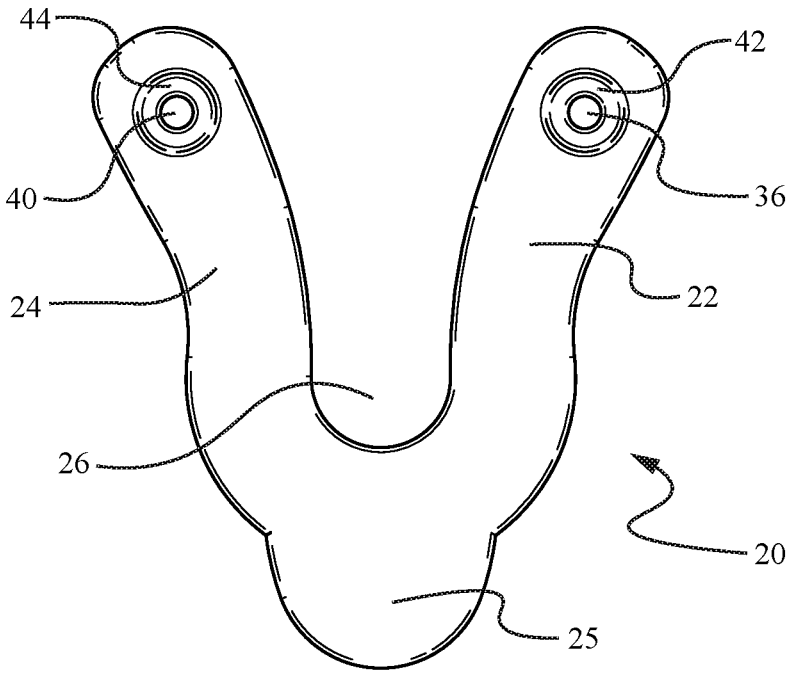
FIG. 3 is a rear elevational view of the lanyard attachment device of FIG. 1.
Figure 4:
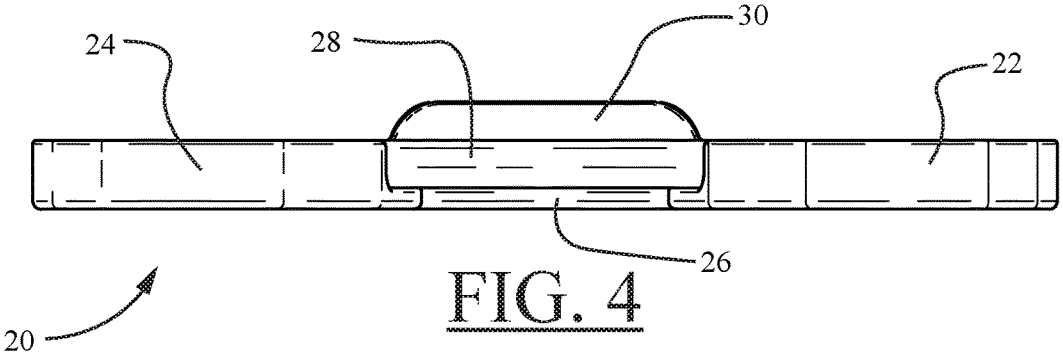
FIG. 4 is a top plan view of the lanyard attachment device of FIG. 1.
Figure 5:
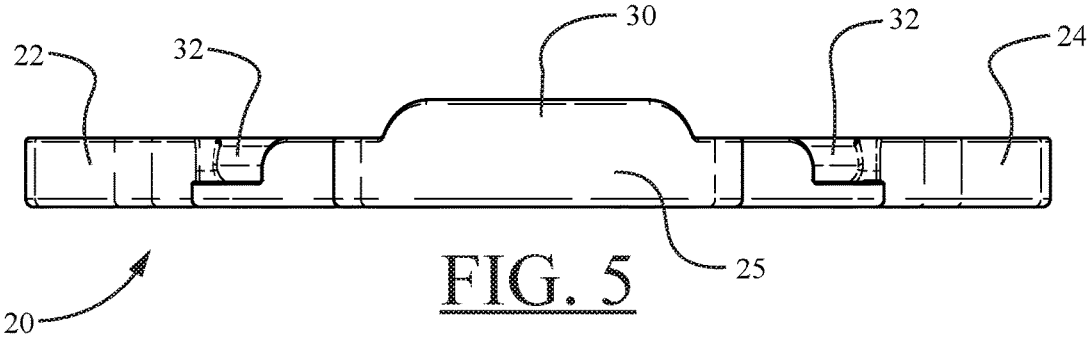
FIG. 5 is a bottom plan view of the lanyard attachment device of FIG. 1.
Figure 6:
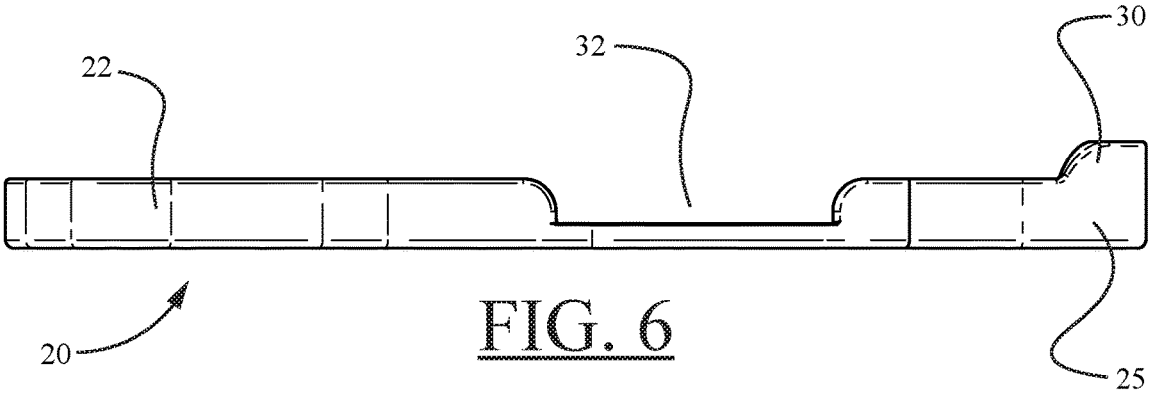
FIG. 6 is a right side elevational view of the lanyard attachment device of FIG. 1.
Figure 7:
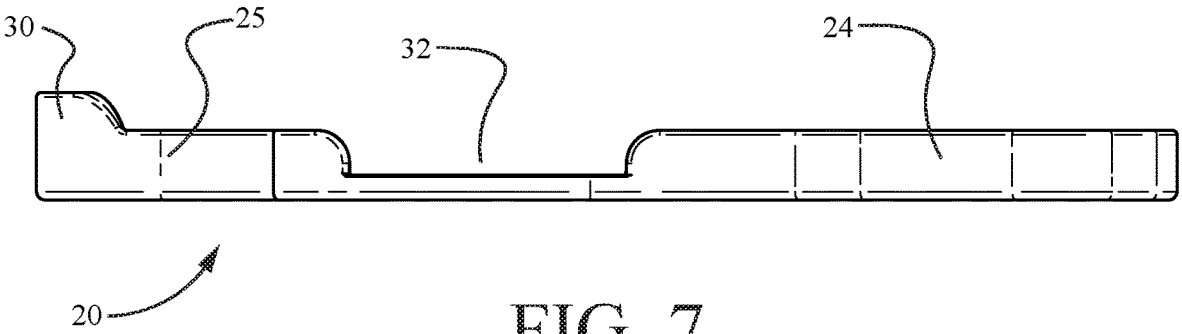
FIG. 7 is a left side elevational view of the lanyard attachment device of FIG. 1.
Figure 8:
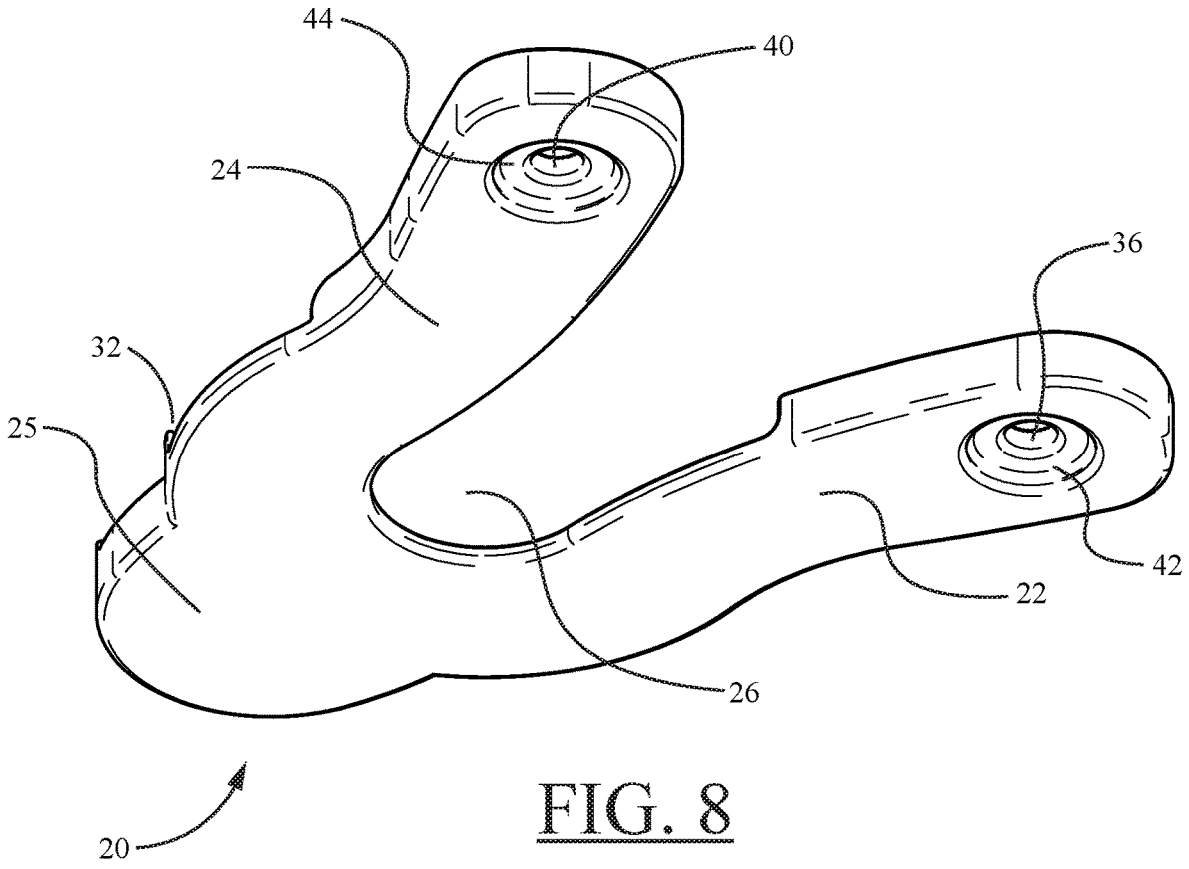
FIG. 8 is a rear-side perspective view of the lanyard attachment device of FIG. 1.
Figure 9:
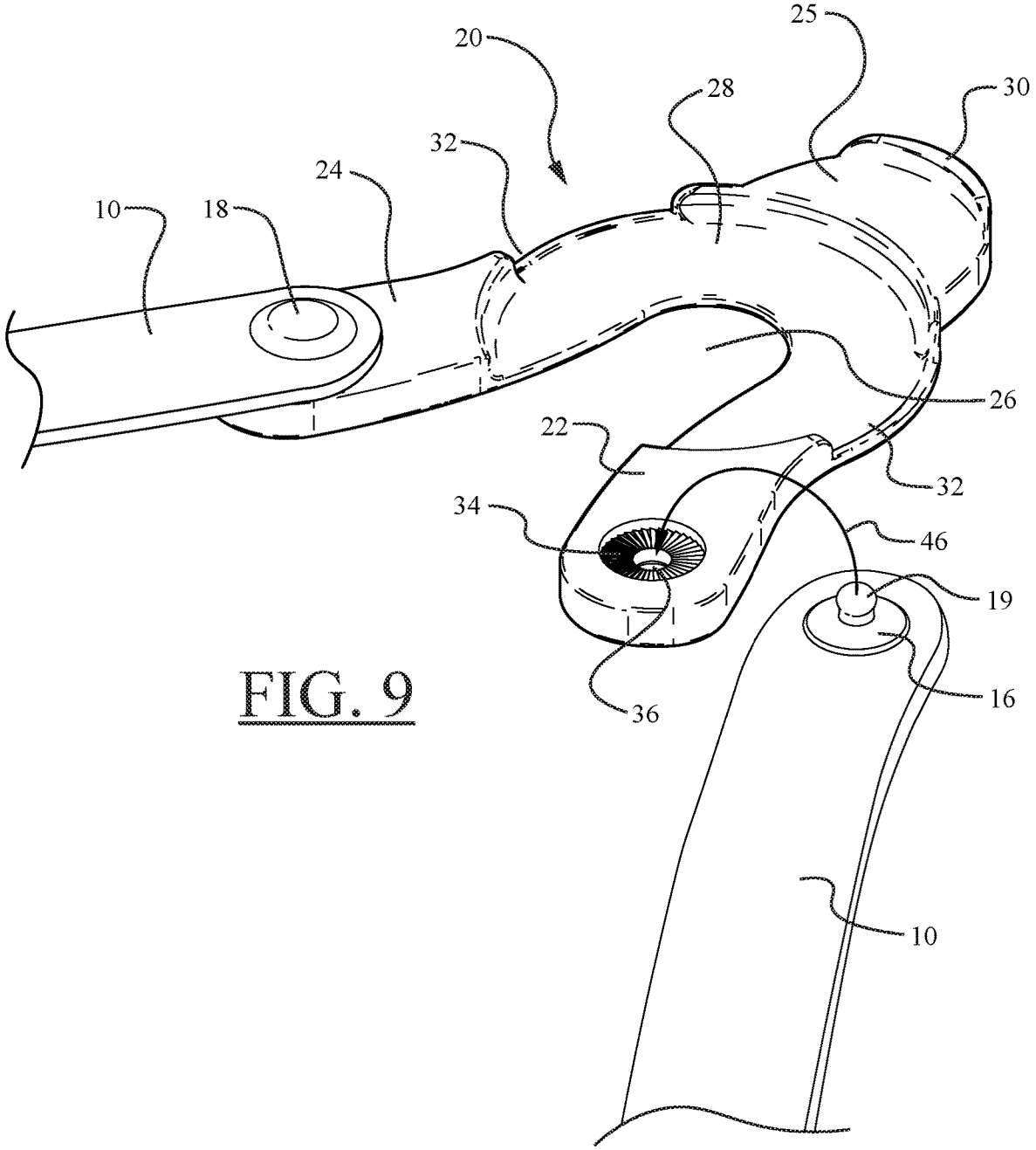
FIG. 9 is another front-side perspective view of the lanyard attachment device of FIG. 1, wherein a lanyard is shown being attached to the lanyard attachment device using a first type of fastener.
Figure 10:
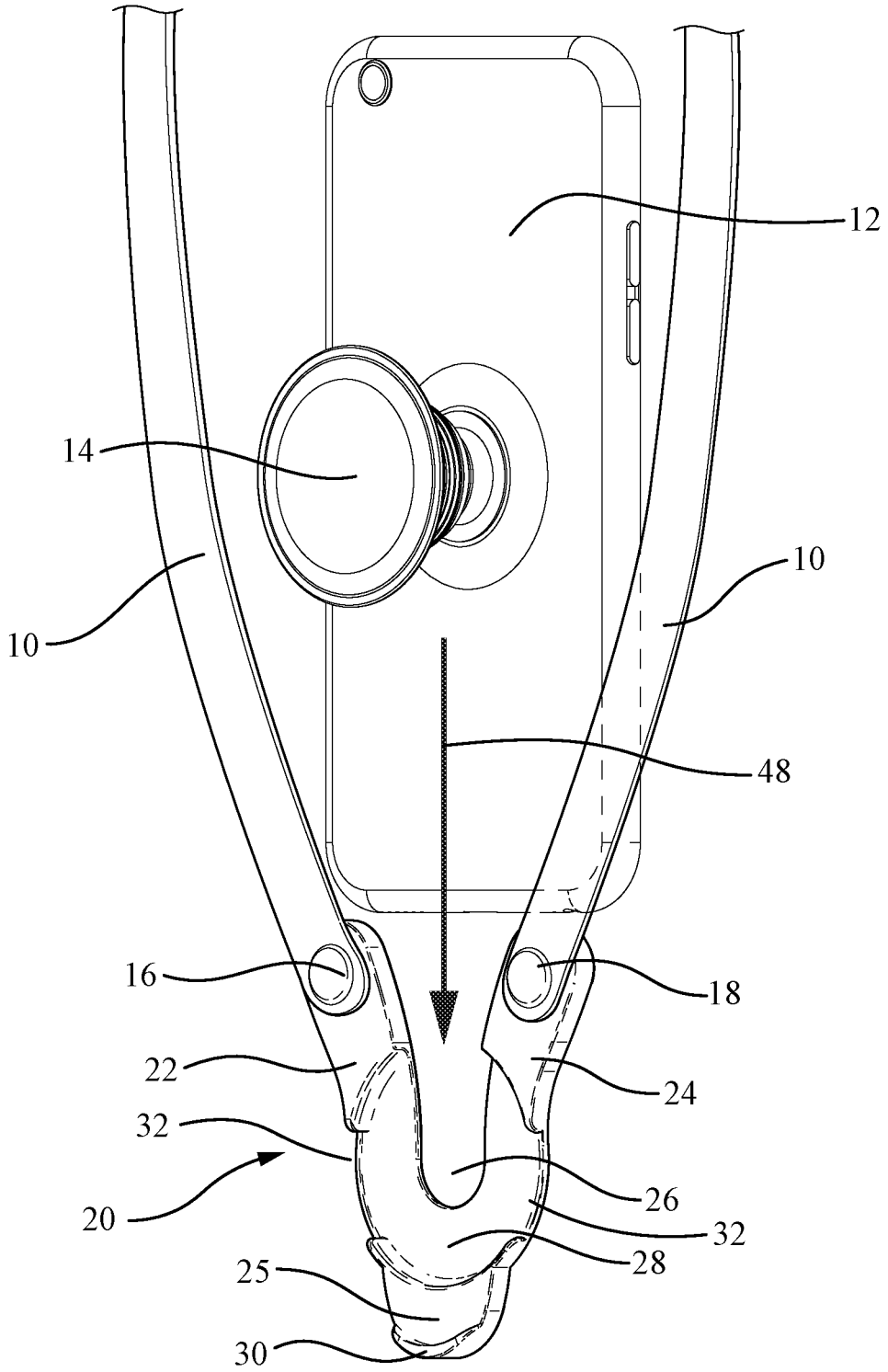
FIG. 10 is a frontal perspective view depicting the lanyard attachment device of FIG. 1 on a lanyard prior to the lanyard attachment device being attached to a handheld electronic device holder on a smartphone.

An illustrative embodiment of a lanyard attachment device is seen generally at 20 in FIGS. 1-12. Initially, referring to FIGS. 1 and 10 of the illustrative embodiment, it can be seen that the lanyard attachment device 20 generally includes a first leg portion 22, the first leg portion 22 configured to be attached to a first end of a lanyard 10; a second leg portion 24, the second leg portion 24 configured to be attached to a second end of the lanyard 10; and a base portion 25 connected to the first leg portion 22 and the second leg portion 24. As shown in FIG. 10, the first leg portion 22, the second leg portion 24, and the base portion 25 collectively define a slot 26 with one closed end for receiving a stem portion of a handheld electronic device holder 14. In the illustrative embodiment, the first leg portion 22, the second leg portion 24, and the base portion 25 collectively form a Y-shaped body configuration. Also, in the illustrative embodiment, the first leg portion 22 of the lanyard attachment device 20 comprises a first fastener aperture 36 configured to receive a first fastener 16 for attaching the first leg portion 22 of the lanyard attachment device 20 to the first end of the lanyard 10 (see e.g., FIGS. 11 and 12), and the second leg portion 24 of the lanyard attachment device 20 comprises a second fastener aperture 40 configured to receive a second fastener 18 for attaching the second leg portion 24 of the lanyard attachment device 20 to the second end of the lanyard 10 (see e.g., FIGS. 10-12). In the illustrative embodiment, each side of the first fastener aperture 36 may comprise a counterbore 34, 42 for accommodating a recessed mounting of the first fastener 16 (see e.g., FIGS. 1-3 and 10). In the illustrative embodiment, each side of the second fastener aperture 40 may comprise a counterbore 38, 44 for accommodating a recessed mounting of the second fastener 18 (see e.g., FIGS. 1-3 and 10). Also, as shown in FIGS. 1 and 2, the counterbores 34, 38 of the first and second fastener apertures 36, 40 on the front face of the lanyard attachment device 20 may comprise a serrated bottom surface for preventing the loosening of the first and second fasteners 16, 18 (i.e., the ridges of the serrations create friction that prevents unwanted, excessive rotation of the lanyard 10 relative to the lanyard attachment device 20).

Referring to the illustrative embodiment of FIG. 9, a first type of fastener 16, 18 that may be used to attach the lanyard 10 to the lanyard attachment device 20 is depicted. As shown in FIG. 9, the first type of fastener 16, 18 comprises a bulb portion 19 that is configured to engage with a respective one of the first and second fastener apertures 36, 40 in the lanyard attachment device 20. More specifically, as diagrammatically indicated by the curved arrow 46 in FIG. 9, the bulb portion 19 of the fastener 16 is configured to snappingly engage with the fastener aperture 36 in the first leg portion 22 of the lanyard attachment device 20. For example, the lanyard attachment device 20 may be formed from a resilient polymeric material or plastic that allows the bulb portion 19 of the fastener 16 to snap into place. Alternatively, the bulb portion 19 of the fastener 16 may be formed from a resilient polymeric material or plastic that allows it to deform when it snaps into the fastener aperture 36.

Figure 16:
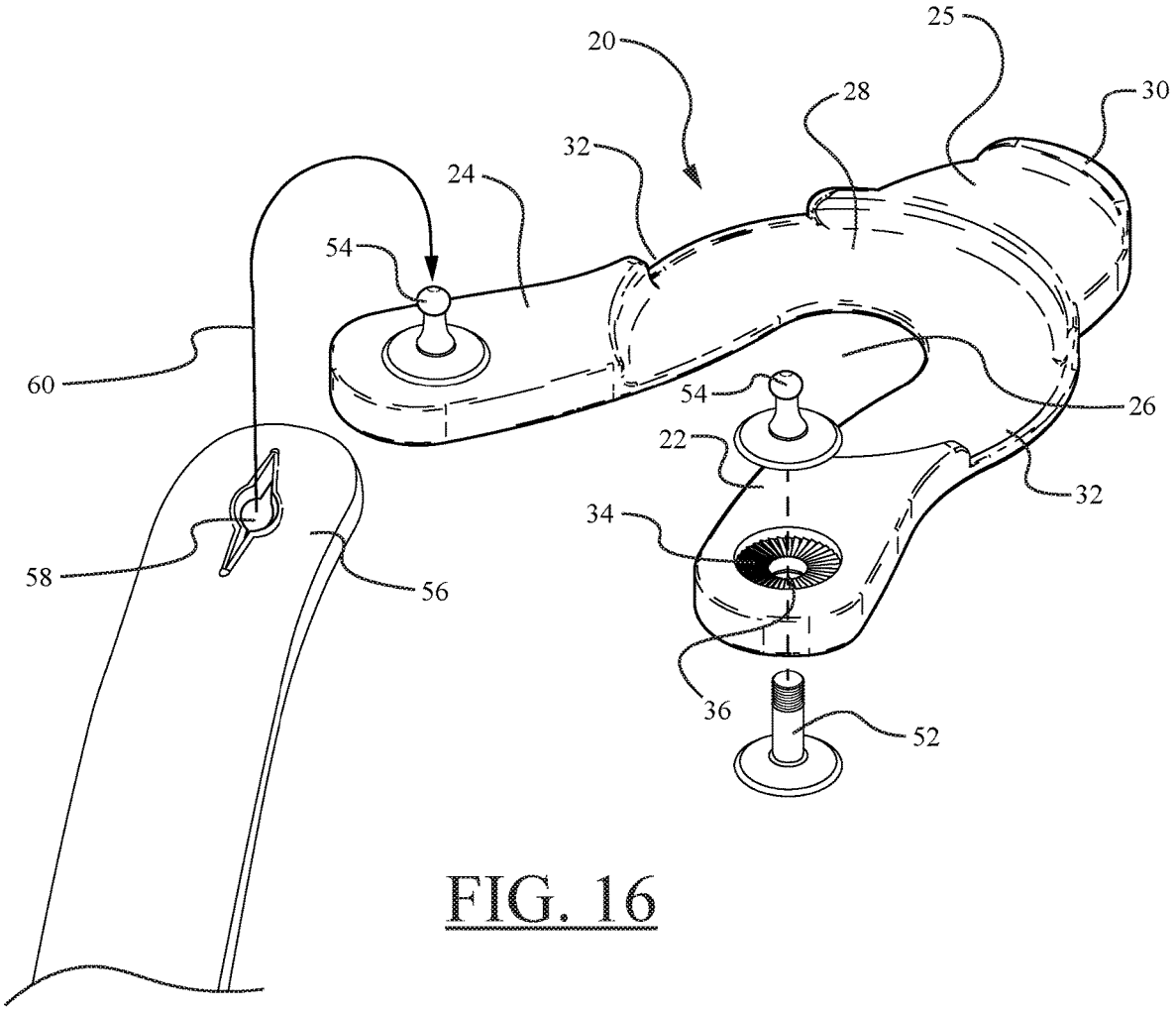
FIG. 16 is yet another front-side perspective view of the lanyard attachment device of FIG. 1, wherein a lanyard is shown being attached to the lanyard attachment device using a second type of fastener.

Referring to the illustrative embodiment of FIG. 16, a second type of fastener 52, 54 that may be used to attach the lanyard 56 to the lanyard attachment device 20 is depicted. As shown in FIG. 16, the second type of fastener, which is in the form of a fastener stud, comprises a first fastener portion 52 and a second fastener portion 54. In this figure, it can be seen that the first fastener portion 52 threadingly engages with the second fastener portion 54 such that the first leg portion 22 of the lanyard attachment device 20 is sandwiched between the first and second fastener portions 52, 54. As shown in FIG. 16, the second fastener portion 54 comprises a stud that is configured to engage with a fastener aperture 58 in the lanyard 56. More specifically, as diagrammatically indicated by the curved arrow 60 in FIG. 16, the stud of the second fastener portion 54 is configured to snappingly engage with the fastener aperture 58 in the lanyard 56 (e.g., the lanyard 56 may be formed from a resilient material, such as a plastic or leather, that allows the stud of the second fastener portion 54 to snap into place within the fastener aperture 58 of the lanyard 56).

Figure 11:
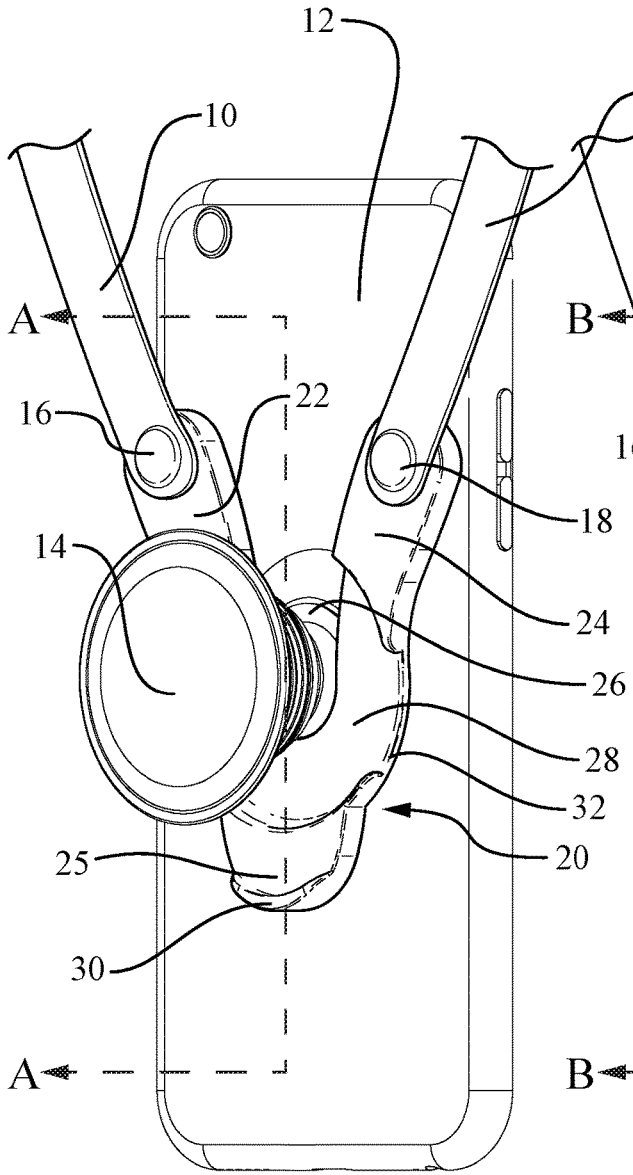
FIG. 11 is another frontal perspective view depicting the stem portion of the handheld electronic device holder on the smartphone being slid into the slot of the lanyard attachment device of FIG. 1.
Figure 12:
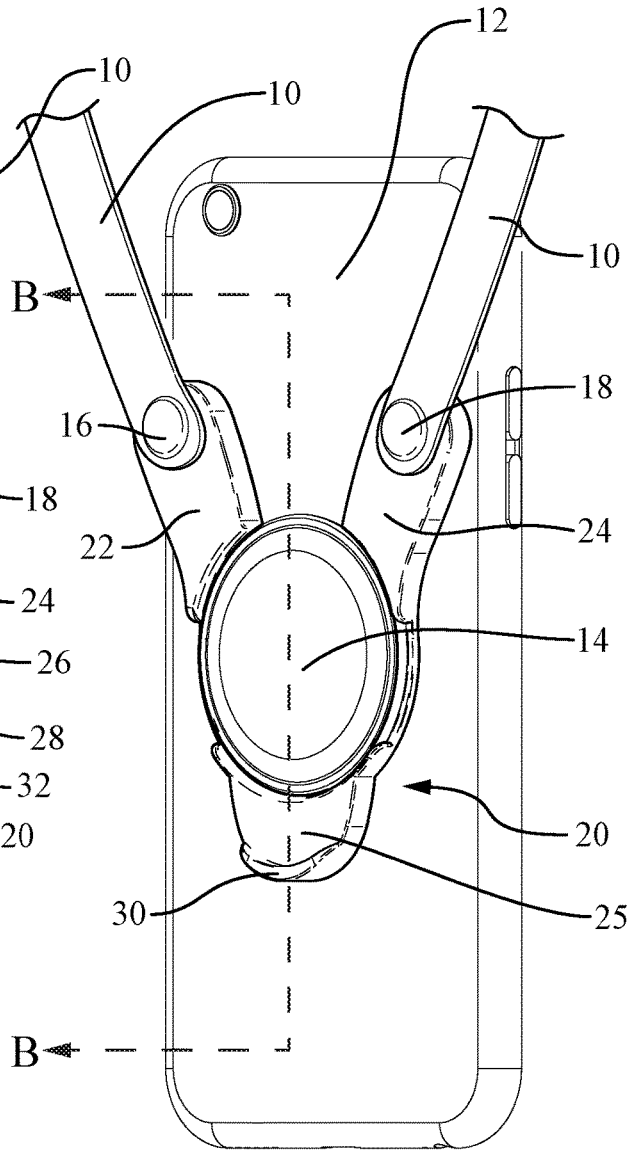
FIG. 12 is yet another frontal perspective view depicting the lanyard attachment device of FIG. 1 secured to the smartphone after the disk portion of the handheld electronic device holder on the smartphone has been collapsed into the recess of the lanyard attachment device.
Figure 15:
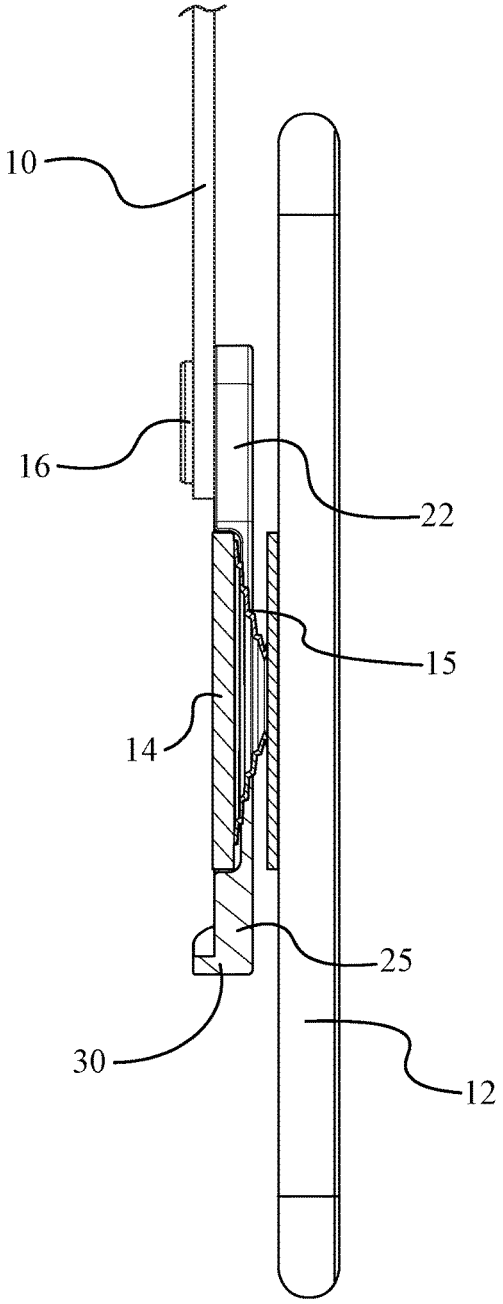
FIG. 15 is a longitudinal sectional view depicting the lanyard attachment device of FIG. 1 secured to the smartphone after the disk portion of the handheld electronic device holder on the smartphone has been collapsed into the recess of the lanyard attachment device, wherein the section is generally cut along the cutting-plane line B-B in FIG. 12.

Referring again to FIG. 1, in the illustrative embodiment, the lanyard attachment device 20 further comprises a circular recess 28 configured to accommodate a recessed mounting of a disk portion of the handheld electronic device holder 14 (see FIGS. 12 and 15). Although, as shown in FIGS. 1, 10, and 11, opposed side portions 32 of the circular recess 28 may be unbounded by walls so as to facilitate the grasping and pulling of the disk portion of the handheld electronic device holder 14 by a user. That is, the open side portions 32 of the circular recess 28 enable a user to more easily use his or her fingers to grasp and pull the disk portion of the handheld electronic device holder 14 to its outward position depicted in FIGS. 10 and 11 where the accordion-like stem portion 15 of the handheld electronic device holder 14 is extended.

Also, as shown in the illustrative embodiment, the lanyard attachment device 20 includes a protruding finger tab portion 30 at the bottom end of the base portion 25 so as to facilitate the grasping of the lanyard attachment device 20 by a user when the smartphone 12 and the handheld electronic device holder 14 mounted thereon is being removed from the lanyard attachment device 20 (see FIGS. 1 and 10-12). More specifically, when the smartphone 12 is being removed from the lanyard attachment device 20, a user grasps and holds the protruding finger tab portion 30 at the base portion 25 of the lanyard attachment device 20 so that the lanyard attachment device 20 is not pulled with the smartphone 12. As such, the protruding finger tab portion 30 allows the accordion-like stem portion 15 of the handheld electronic device holder 14 to be more easily removed from the upper open end of slot 26 without the lanyard attachment device 20 catching on the accordion-like stem portion 15 and being pulled with the smartphone 12.

Figure 14:
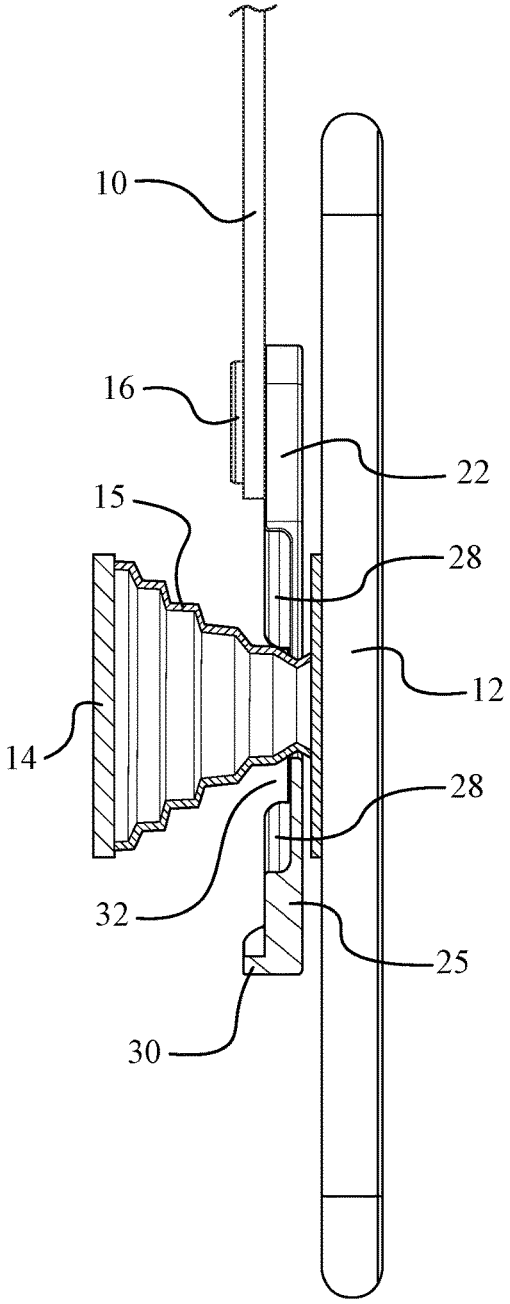
FIG. 14 is a longitudinal sectional view depicting the lanyard attachment device of FIG. 1 on a lanyard prior to the lanyard attachment device being attached to a handheld electronic device holder on a smartphone, wherein the section is generally cut along the cutting-plane line A-A in FIG. 11.

Now, with reference to FIGS. 10-12, 14, and 15, the manner in which the handheld electronic device holder 14 of the smartphone 12 is secured to the lanyard attachment device 20 will be described. First, as shown in FIGS. 11 and 14, a user pulls open the handheld electronic device holder 14 such that its accordion-like stem portion 15 is fully extended, and aligns the stem portion 15 of the handheld electronic device holder 14 with the slot 26 of the lanyard attachment device 20. Then, as shown in FIGS. 11 and 14, the user inserts the stem portion 15 of the handheld electronic device holder 14 into the slot 26 of the lanyard attachment device 20 until the stem portion 15 is adjacent to the closed bottom end of the slot 26. Finally, as depicted in FIGS. 12 and 15, the user closes the handheld electronic device holder 14 so that the disk portion of the handheld electronic device holder 14 is received securely within the recess 28 of the lanyard attachment device 20 with the front surface of the disk portion being disposed generally flush with the front face of the lanyard attachment device 20 (see FIG. 15). In the position of FIGS. 12 and 15, the smartphone 12 is securely attached to the lanyard attachment device 20.

As such, it is readily apparent that the lanyard attachment device 20 works well with a popular phone attachment, namely the handheld electronic device holder 14 (e.g., such as those known as the PopSockets®). The lanyard attachment device 20, which is in the form of saddle clip, is also able to work with a custom disk attached to the back of a phone, or built into a phone case, with a similar up/down motion for locking in place. The lanyard attachment device 20 described herein takes advantage of features of the handheld electronic device holder 14 that were meant for other purposes (e.g., for finger or hand holding of the phone, and for collapsing the holder 14 for compactness). As explained above, the handheld electronic device holder 14 or another device is placed in an extended position to slide into the lanyard attachment device 20. Closing the disk portion of the handheld electronic device holder 14 or other device locks the phone 12 in place on the lanyard attachment device 20, and provides additional attachment security (see e.g., FIGS. 12 and 15). By means of the open sides 32 of the recess 28 described above, the lanyard attachment device 20 is designed for easy finger access to pull open the handheld electronic device holder 14 or other device and release the phone 12. This lanyard attachment device 20 is able to work with any attachment that can be extended and compressed, stretched and retracted, rotated up and rotated down, spring-loaded, snapped in place, or toggled up and toggled down.

Advantageously, the lanyard attachment device 20 provides a lead-in to easily guide the cell phone 12 into place. This lead-in has a stop or saddle bottom (i.e., the closed end of slot 26), which prevents release of the device in this downward direction. The lanyard attachment device 20 provides features that prevent side-to-side motion or release in the side-to-side direction. Once the mating component is moved, compressed, pushed down, or by other action engaged, the additional features on the lanyard attachment device 20 prevent removal of the device from the lanyard 10 in the direction of loading, as well as side-to-side or up-down. Once engaged or locked in place, the lanyard attachment device 20 prevents accidental dropping even if the lanyard attachment device 20 is turned upside down.

In one or more other embodiments, the lanyard attachment device 20 may be used independently as a holding device without a lanyard 10. The lanyard attachment device 20 could be attached to or made part of a purse, an article of clothing, or be built into a car dash holder, car vent holder, or desk phone holder.

The lanyard 10 that attaches to the lanyard attachment device 20 can be in many different forms. The lanyard 10 can be hung from the neck, or longer in a cross-body type, or hung from the waist, hip, or belt area. The lanyard 10 can contain printing, including advertising or other messages or logos. The lanyard 10 can be a fashion item, with different materials, colors, shapes and form factors to match a desired look. The lanyard 10 and lanyard attachment device 20 can be made of a sterilizable material so it can be used in medical or hospital settings. The lanyard 10 can be a fixed length or adjustable to fit different body shapes, sizes, and preferences. The lanyard 10 can be easily swapped with another lanyard 10 as the connection mechanism to the solid lanyard attachment device 20 can be simple screws, rivets, knotted connection, or snaps. The lanyard attachment device 20 may be made of numerous materials including, but not limited to plastics or metals. The preferred embodiment for the lanyard attachment device 20 is strong plastic. This allows for low cost as well as preventing the scratching of a phone 12 or other device being held. The lanyard attachment device 20 also could be made of metal, rubber, or other suitable rigid materials.

In one or more other embodiments, the lanyard attachment device 20 is a passive element and the mating attachment piece on the back of the phone 12 or other device is an active element with motion toward and away from the phone 12. The motion away from the device opens a gap to accept the lanyard attachment device 20. This mating piece can also be a spring-loaded part that flexes to allow the lanyard attachment device 20 into position, and springs back to hold the lanyard attachment device 20. The motion toward the phone 12 captures the lanyard attachment device 20, thus preventing the phone 12 from falling out.

Figure 13:
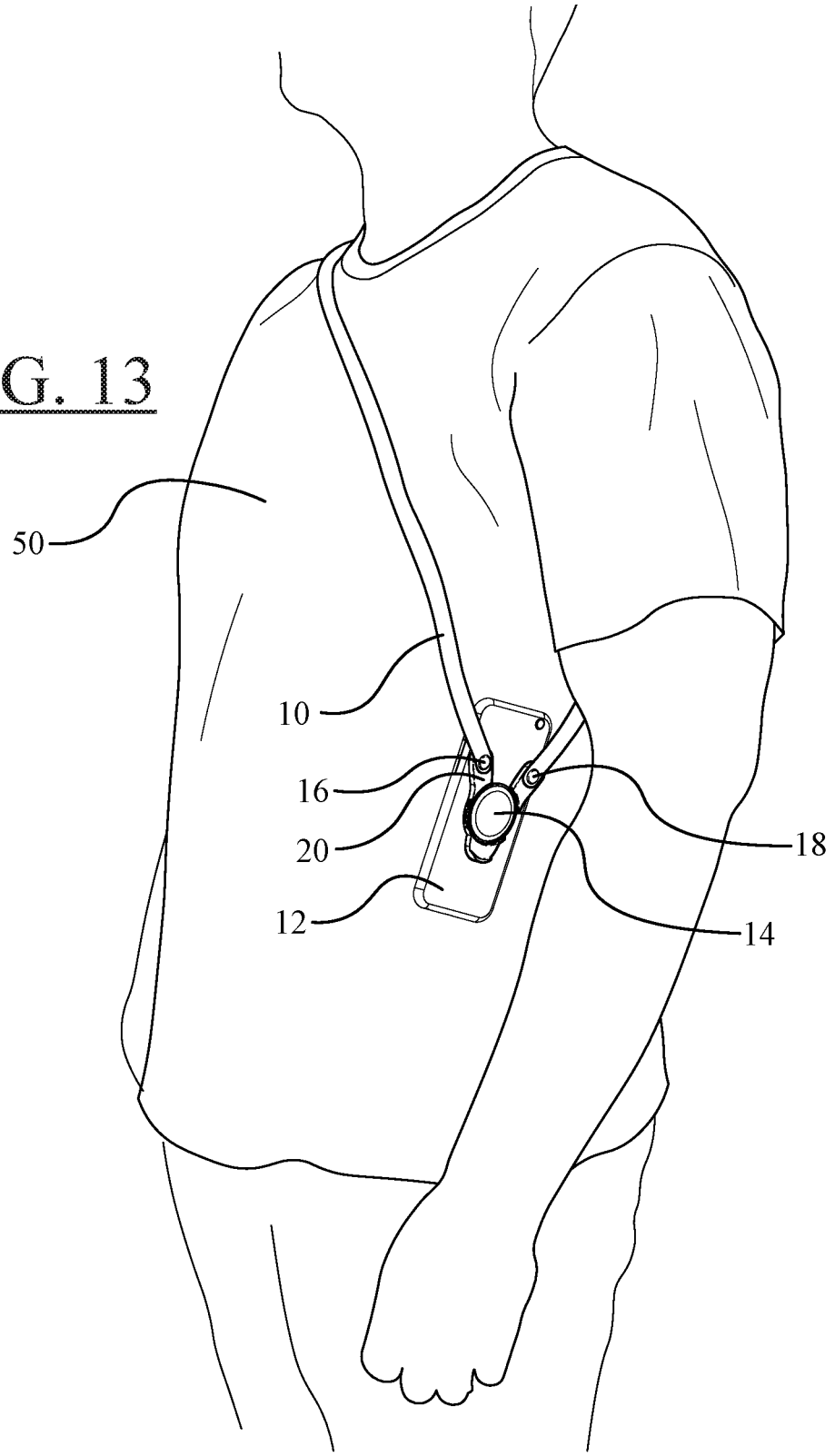
FIG. 13 is a perspective view of a lanyard system, which includes the lanyard attachment device of FIG. 1, being used to support a smartphone from a body of a user.

In one or more other embodiments, the phone 12 is able to freely rotate while being securely held on the lanyard attachment device 20 and lanyard 10. This rotation is a unique feature. This allows the phone 12 to be utilized even while on the lanyard 10. Someone could hold up the phone 12 and take a photo in landscape or portrait positions. The phone 12 also can be held up to view texts, or other information in landscape or portrait positions. The phone 12 can also be held up to the ear and used as a phone 12 while still connected. Because the lanyard 10 is attached to the back of the phone 12, it allows full access to the screen with no corners or edges being blocked. The phone 12 can be held on the lanyard 10 so the screen is toward the individual, maintaining privacy and protecting the screen. For example, as shown in FIG. 13, a lanyard system, which includes the lanyard 10 and the lanyard attachment device 20, is being used to support a smartphone 12 from a body of a user 50. In FIG. 13, the touchscreen of the smartphone 12 is disposed against the body of the user 50 to protect the touchscreen. However, in other embodiments, the smartphone 12 may be supported using the lanyard system such that the touchscreen of the smartphone 12 is disposed facing outwardly from the body of the user 50.

In one or more other embodiments, the back of the lanyard attachment device 20 that is in contact with the phone 12 is smooth or has minimal features to prevent scratching of the phone surface. The smooth surface also aids the phone 12 insertion and removal out of the lanyard attachment device 20. Any connection points to connect to the lanyard 10 are preferably recessed to prevent scratching of the phone 12, and to avoid any catch points that would make insertion and removal of the phone 12 more difficult.

In one or more other embodiments, the lanyard attachment device 20 may be used to hold other small handheld devices, wallets, purses, cases, etc. This can work for most anything that needs to be kept handy and that may not fit in a pocket, or when a pocket is unavailable. Other small items that need to be handy and could be held securely with this lanyard attachment device 20 include, but are not limited to e-cigarettes, vape devices, cameras, keys, video and audio recorders, golf tracking devices, golf items, tools, tool kits, medical devices, medical monitors, location trackers, pagers, fall detectors, sunglasses, glasses, keys, remote controls, wallets, purses, change purses, badges, and medicine delivery devices. Also, in addition to phones, the lanyard attachment device 20 may be used to hold many other types of mobile communication devices, such as walkie talkies, police radio type of devices, warehouse worker's communication devices, etc.

It is readily apparent that the aforedescribed lanyard attachment device 20 offers numerous advantages. First, the lanyard attachment device 20 allows someone to easily attach and carry their phone 12 on a lanyard 10. In addition, the lanyard attachment device 20 allows an easy on attachment, a secure attachment, and easy off detachment for quick accessibility to the phone 12.

Advantageously, the aforedescribed lanyard 10 and lanyard attachment device 20 provides a convenient method of carrying a cell phone or other small electronic device or item that you want close by, but not in a pocket. Also, advantageously, the lanyard attachment device 20 works with a popular holder device (e.g., PopSockets®) that is already on the back of many phones. Thus, lanyard attachment device 20 described herein results in an easy method to securely and fashionably hold a phone.

In addition, the lanyard 10 can be used to hold additional items that an individual carries or wants on a frequent basis.

For example, the lanyard 10 may have further attachment points or devices to hold a license, identification (ID) cards, credit cards or cash, or to hold glasses or sunglasses, keys or other entry cards or devices, pens, pencils or other writing implements, e-cigarettes, cartridges, cigarettes, other smoking devices or paraphernalia, lighters, lip-balm, lip-stick, medical instruments, medications, cough drops, eye drops, contact lenses, pills, cologne, perfume, makeup, a breath freshener, a mini mirror, personal protective device or devices, and/or toothbrush and toothpaste. Thus, the lanyard 10 can conveniently hold a number of items that individuals want to carry with them. These types of items are smaller and are often misplaced by putting them down and forgetting the location. The lanyard may be slim with built-in quick attachment points, or quick release devices to easily add an item or remove an item. The lanyard may also be wider and have built-in pockets to hold these items. The pockets could be zipper pockets, or simple open pockets, or stretchy material pockets to firmly hold these items in place. The pockets may also have a clear window for easy viewing of a license or other forms of identification (ID).

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claim(s) in any manner. Rather, the scope of the invention is defined only by the claim(s) and their equivalents, and not, by the preceding description.

The invention claimed is:

1. A lanyard attachment device, comprising:

a first leg portion having a first connecting element, the first leg portion configured to be attached to a first end of a lanyard by means of the first connecting element;

a second leg portion having a second connecting element, the second leg portion configured to be attached to a second end of the lanyard by means of the second connecting element;

a base portion connected to the first leg portion and the second leg portion, the first leg portion and the second leg portion extending upwardly from the base portion, the first leg portion, the second leg portion, and the base portion collectively defining a closed-ended slot for receiving a stem portion of a device holder where the first leg portion, the second leg portion, and the base portion each define a portion of the closed-ended slot; and a recess formed by a portion of each of the first leg portion, the second leg portion, and the base portion, the recess configured to accommodate a recessed mounting of a disk portion of the device holder.

2. The lanyard attachment device according to claim 1, wherein the first connecting element comprises a first fastener, and wherein the first leg portion of the lanyard attachment device comprises a first fastener aperture configured to receive the first fastener for attaching the first leg portion of the lanyard attachment device to the first end of the lanyard.

3. The lanyard attachment device according to claim 2, wherein the second connecting element comprises a second fastener, and wherein the second leg portion of the lanyard attachment device comprises a second fastener aperture configured to receive the second fastener for attaching the second leg portion of the lanyard attachment device to the second end of the lanyard.

4. The lanyard attachment device according to claim 2, wherein at least one side of the first fastener aperture comprises a counterbore for accommodating a recessed mounting of the first fastener.

5. The lanyard attachment device according to claim 4, wherein the counterbore comprises a serrated bottom surface for preventing a loosening of the first fastener.

6. The lanyard attachment device according to claim 1, wherein at least one side portion of the recess is unbounded by a wall so as to facilitate a grasping and pulling of the disk portion of the device holder by a user.

7. The lanyard attachment device according to claim 1, wherein the recess is circular in shape.

8. The lanyard attachment device according to claim 1, wherein the first leg portion, the second leg portion, and the base portion collectively form a Y-shaped body configuration.

9. The lanyard attachment device according to claim 1, further comprising a protruding finger tab portion at a bottom end of the base portion so as to facilitate a grasping of the lanyard attachment device by a user when a handheld device is being removed from the lanyard attachment device.

10. A lanyard system, comprising:

a lanyard having a first end and a second end; and a lanyard attachment device that includes:

a first leg portion having a first connecting element, the first leg portion configured to be attached to the first end of the lanyard by means of the first connecting element;

a second leg portion having a second connecting element, the second leg portion configured to be attached to the second end of the lanyard by means of the second connecting element;

a base portion connected to the first leg portion and the second leg portion, the first leg portion and the second leg portion extending upwardly from the base portion, the first leg portion, the second leg portion, and the base portion collectively defining a closed-ended slot for receiving a stem portion of a device holder where the first leg portion, the second leg portion, and the base portion each define a portion of the closed-ended slot; and a recess formed by a portion of each of the first leg portion, the second leg portion, and the base portion, the recess configured to accommodate a recessed mounting of a disk portion of the device holder.

11. The lanyard system according to claim 10, wherein the first connecting element comprises a first fastener, and wherein the first leg portion of the lanyard attachment device comprises a first fastener aperture configured to receive the first fastener for attaching the first leg portion of the lanyard attachment device to the first end of the lanyard.

12. The lanyard system according to claim 11, wherein the second connecting element comprises a second fastener, and wherein the second leg portion of the lanyard attachment device comprises a second fastener aperture configured to receive the second fastener for attaching the second leg portion of the lanyard attachment device to the second end of the lanyard.

13. The lanyard system according to claim 11, wherein at least one side of the first fastener aperture comprises a counterbore for accommodating a recessed mounting of the first fastener, the counterbore comprising a serrated bottom surface for preventing a loosening of the first fastener.

14. The lanyard system according to claim 10, wherein the recess is circular in shape, and wherein at least one side portion of the recess is unbounded by a wall so as to facilitate a grasping and pulling of the disk portion of the device holder by a user.

15. The lanyard system according to claim 10, wherein the first leg portion, the second leg portion, and the base portion of the lanyard attachment device collectively form a Y-shaped body configuration.

16. The lanyard system according to claim 10, wherein the lanyard attachment device further comprises a protruding finger tab portion at a bottom end of the base portion so as to facilitate a grasping of the lanyard attachment device by a user when a handheld device is being removed from the lanyard attachment device.

17. The lanyard system according to claim 10, wherein the lanyard attachment device is configured to couple a smartphone to the lanyard.

18. The lanyard system according to claim 17, wherein the device holder comprises a handheld electronic device holder for the smartphone, and wherein the closed-ended slot of the base portion of the lanyard attachment device is configured to receive the stem portion of the handheld electronic device holder.

19. The lanyard attachment device according to claim 1, wherein a front surface of the disk portion of the device holder is configured to be disposed generally flush with a front face of the lanyard attachment device when the disk portion of the device holder is recess-mounted in the recess of the lanyard attachment device.

20. The lanyard system according to claim 10, wherein a front surface of the disk portion of the device holder is configured to be disposed generally flush with a front face of the lanyard attachment device when the disk portion of the device holder is recess-mounted in the recess of the lanyard attachment device.

* * * * *